US006398663B1

(12) United States Patent
Lin

(10) Patent No.: US 6,398,663 B1
(45) Date of Patent: Jun. 4, 2002

(54) GOLF POSITION AND PARALLEL INDICATING DEVICE FOR THE TOP OF BACKSWING

(76) Inventor: Teh-Cheng Lin, 46734 Rancho Higuera Rd., Fremont, CA (US) 94539

( * ) Notice: Subject to any disclaimer, the term of this patent is extended or adjusted under 35 U.S.C. 154(b) by 0 days.

(21) Appl. No.: 09/477,008

(22) Filed: Jan. 3, 2000

(51) Int. Cl.[7] ..... A63B 69/36
(52) U.S. Cl. ..... 473/220; 473/221; 473/224
(58) Field of Search ..... 473/220, 221, 473/223, 224, 219, 222, 226, 233, 234

(56) References Cited

U.S. PATENT DOCUMENTS 3,106,403 A * 10/1963 Kirkman ..... 473/224
3,758,117 A 9/1973 Harrison
4,381,111 A 4/1983 Richards
4,526,374 A 7/1985 Ban
4,819,942 A * 4/1989 Lee et al. ..... 473/224
5,184,826 A * 2/1993 Hall, Jr. ..... 473/224
5,330,189 A * 7/1994 Reichow ..... 473/224
5,711,717 A 1/1998 Richards
5,865,685 A 2/1999 Thomas
5,895,328 A * 4/1999 Pahio ..... 473/220
5,911,635 A * 6/1999 Ogden ..... 473/224
5,941,779 A * 8/1999 Zeiner-Gunderson ..... 473/224

* cited by examiner

*Primary Examiner*—Mark S. Graham
*Assistant Examiner*—Raeann Gorden
(74) *Attorney, Agent, or Firm*—Michael I. Kroll

(57) ABSTRACT

The present invention 10 discloses a golf club 12 having a canister-like housing 46 attached thereto. The housing 46 contains a group of mercury switches 58, 59 mounted internally on a pair of rotatable platforms 46 between two discs 60 which discs are connected to a rotational dial member 48 having a scale of degrees 52 displayed thereon. The rotational dial member 48 functions with a number of fixedly connected elements in concert with the mercury switches 58, 59 to selectively actuate a plurality of LED's 16 which LED's indicate the physical relationship of the golf club 12 with a fixed object, e.g., the ground, so that the golfer 18 can practice his/her golf swing.

13 Claims, 12 Drawing Sheets

GOLF POSITION AND PARALLEL INDICATING DEVICE FOR THE TOP OF BACKSWING

BACKGROUND OF THE INVENTION

1. Field of the Invention

The present invention relates generally to golfing accessories and, more specifically, to a visual indicator device which mounts onto a golf club to aid the golfer in determining and developing a consistent backswing.

The canister-like housing has a rotatable drum dial member having a scale of degrees of arc marked on the exterior periphery to permit the user to pre-select the desired rotation of angle of the golf club shaft in relationship to the ground. This allows the golfer to pre-select the desired rotation of the club head while the shaft is parallel to the ground. When the golfer completes his backswing they can look over their shoulder to see if the appropriate LED's are lit and if not, adjust their swing accordingly. Through repetitious practice they will learn when the golf club has reached the desired rotation of the club head while parallel to the ground.

The canister-like housing member has an array of LED's on the proximal canister-like housing end and the rotatable drum dial member on the distal housing end. The rotatable drum dial member is comprised of a number of fixedly connected elements which function in concert having the LED's on the proximal end providing the visual indication of the performance of the golfer.

The rotatable drum dial member is fixedly connected to two platforms of mercury switches retained between two discs forming a spool-like support element for the first mercury switch holder and the second mercury switch holder. Also, fixedly connected to the rotatable drum dial member is a rotational limiting element and a spur gear element which communicates with a pawl-like member extending from the spool retaining member to maintain the positioning of the rotatable drum dial member and its elements. The first switch holder is comprised of two sets of four switches. The first set is connected in series radiating on an equal slope from the holder center equidistant from each other. The first switch set is connected to a single LED. The second set are individually connected to a mating LED and radiate on an equal slope from the holder center equidistant from each other and interdisposed between the switches of the first set.

The second switch holder is comprised of four switches that are individually connected to a mating LED and radiate on an equal slope from the holder center equidistant from each other. Two switches being parallel to the club shaft and two switches being perpendicular to the club shaft.

2. Description of the Prior Art

There are other golf club devices designed for improving the swing of a golfer. Typical of these is U.S. Pat. No. 3,758,117 issued to Harrison on Sep. 11, 1973.

Another patent was issued to Richards on Apr. 26, 1983 as U.S. Pat. No. 4,381,111. Yet another U.S. Pat. No. 4,526,374 was issued to Ban on Jul. 2, 1985 and still yet another was issued on Jan. 27, 1998 to Richards as U.S. Pat. No. 5,711,717. Another patent was issued to Thomas on Feb. 2, 1999 as U.S. Pat. No. 5,865,685.

U.S. Pat. No. 3,758,117

Inventor: John G. Harrison

Issued: Sep. 11, 1973

The inertia attachment includes an arm on which is a weight adjustable longitudinally of the arm and a clamp adapted to attach the arm to the shaft of a golf club which requires follow-through when swung; the weight has tail fins and is shaped to be directional in the direction into which the shaft is swung and is registerable with the head of the golf club or the like; the arm is pivoted on the clamp so as to be adjustable from an out of the way position parallel with the shaft toward and above the club head. In one embodiment, the weight may include a rotatable propeller mounted in a recess between the tail fins. In another embodiment, the weight is shiftable along a shaft and compresses a spring as the weight moves rearwardly. The weight includes a passage through which the arm extends, and the weight may be secured in various positions along the length of the arm by the provision of a spring clip located in the passage. The spring clip is adapted to selectively engage grooves provided along the length of the arm.

U.S. Pat. No. 4,381,111

Inventor: Ralph H. A. Richards

Issued: Apr. 26, 1983

A golf swing simulator comprises a handle pivotally connected about an axis to an arm, which in turn is pivotally connected about an axis to a mounting. The mounting includes two parts which are adjustable to vary the angle of the axis to the horizontal. The connection between the handle and the arm is via a crank, pivot axis and means for adjusting the angle of the axis relative to the axis. This latter angular adjustment is centered about the point of intersection (X) of the pivot axis with the longitudinal axis of the handle.

U.S. Pat. No. 4,526,374

Inventor: Thomas E. Ban

Issued: Jul. 2, 1985

A golf practicing device is described as being a golf ball which is tethered to a casting-type fishing reel which is attached to a portable bracket which, in turn, is detachably mounted adjacent the handgrip on the shaft of a golf club, such as a chipping iron or putter. A pair of eyelets is provided on the bracket opposite and, in line, with the fishing reel to guide the line from the reel as it pays out from the reel upon stroking or hitting the ball with the club head. Thus, after putting or hitting the ball, the player only need rewind the reel to return the ball for another practice shot.

U.S. Pat. No. 5,711,717

Inventor: Jan. 27, 1998

Issued: Ralph Henry Arthur Richards

Apparatus for guiding a simulated golf swing consists of a golf club handle fixed at one end of a mechanical linkage whose other end can be fixed to a wall. The handle is fixed, so as to be rotatable about its own axis, to a crank of the linkage. The crank is connected in turn to an elongated arm pivoted at the fixing location so as to guide a swing in a basic arc. A central pivot of the crank permits the user's wrists to flex during the swing.

U.S. Pat. No. 5,865,685

Inventor: Joseph G. Thomas

Issued: Feb. 2, 1999

A golf swing improvement device that includes two adjustable wrist encircling members, a golf club gripping member capable of fitting on any golf club, and a stretchable, flexible linear portion having two end areas. One of the end areas is attached to one of the wrist encircling members and the other end area is attached to the other wrist-encircling member. A central area of the linear portion is firmly held by the golf club gripping member so that the length of linear portion extending between each wrist encircling member and the golf club gripping member may be separately adjusted in length.

While these golf club devices designed for improving the swing of a golfer may be suitable for the purposes for which they were designed, they would not be as suitable for the purposes of the present invention, as hereinafter described.

SUMMARY OF THE PRESENT INVENTION

The present invention discloses a golf club having a cylinder-like housing attached thereto. The housing contains a group of mercury switches mounted internally on a pair of rotatable platforms between two discs which discs are connected to a rotational dial member having a scale of degrees displayed thereon. The rotational dial member functions with a number of fixedly connected elements in concert with the mercury switches to selectively actuate a plurality of LED's which LED's indicate the physical relationship of the golf club with a fixed object, e.g., the ground, so that the golfer can practice his/her golf swing.

A primary object of the present invention is to provide a visual indicator which can be attached to a golf club.

Another object of the present invention is to provide a visual indicator which can be easily viewed by the golfer while the club is at the top of the backswing.

Yet another object of the present invention is to provide a visual indicator for determining if the club shaft is parallel to the ground at the top of the backswing.

Still yet another object of the present invention is to provide a visual indicator which can be viewed at the top of the backswing indicating in what direction the club head has deviated from a predetermined angle.

Yet another object of the present invention is to provide a visual indicator having means for selecting desired degrees of rotation of the club head which can be verified by an LED display at the top of the backswing.

Additional objects of the present invention will appear as the description proceeds.

The present invention overcomes the shortcomings of the prior art by providing a visual indicator device which mounts onto a golf club to aid the golfer in determining and developing a consistent backswing.

The canister-like housing has a rotatable drum dial member having a scale of degrees of arc marked on the exterior periphery to permit the user to pre-select the desired rotation of angle of the golf club shaft in relationship to the ground. This allows the golfer to pre-select the desired rotation of the club head while the shaft is parallel to the ground. When the golfer completes his backswing they can look over their shoulder to see if the appropriate LED's are lit and if not, adjust their swing accordingly. Through repetitious practice they will learn when the golf club has reached the desired rotation of the club head while parallel to the ground.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

The rotatable drum dial member is fixedly connected to two platforms of mercury switches retained between two discs forming a spool-like support element for the first mercury switch holder and the second mercury switch holder. Also, fixedly connected to the rotatable drum dial member is a rotational limiting element and a spur gear element which communicates with a pawl-like member extending from the spool retaining member to maintain the positioning of the rotatable drum dial member and its elements. The first switch holder is comprised of two sets of four switches. The first set is connected in series radiating on an equal slope from the holder center equidistant from each other. The first switch set is connected to a single LED. The second set are individually connected to a mating LED and radiate on an equal slope from the holder center equidistant from each other and interdisposed between the switches of the first set.

The second switch holder is comprised of four switches that are individually connected to a mating LED and radiate on an equal slope from the holder center equidistant from each other. Two switches being parallel to the club shaft and two switches being perpendicular to the club shaft.

Figure 6:
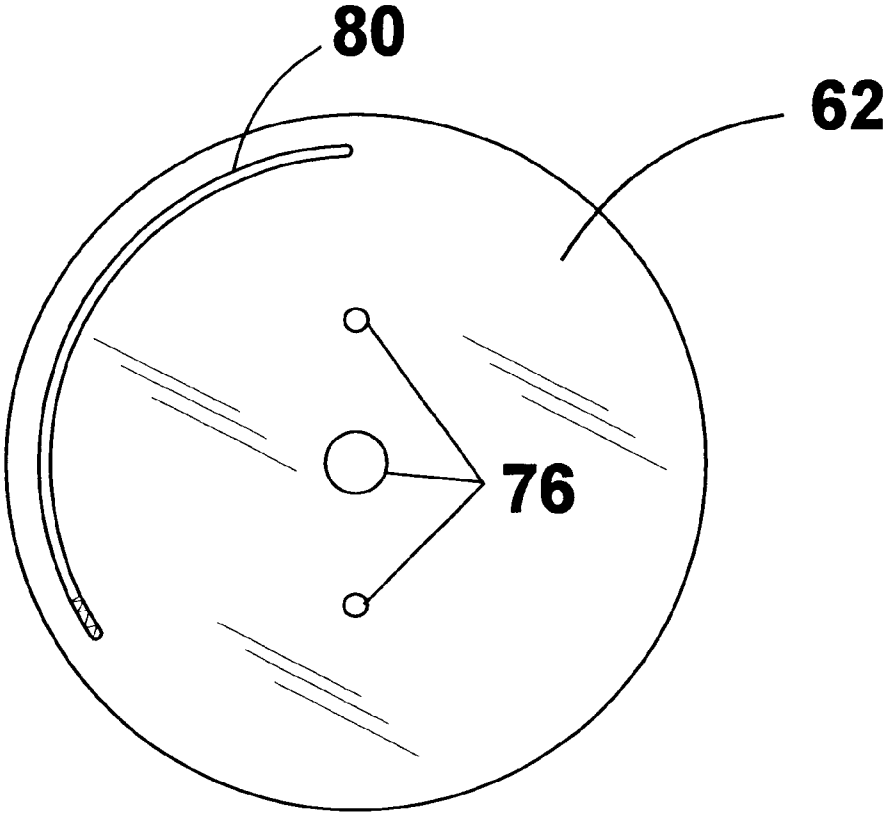

FIG. 6 is a front view of the rotational limiting element which is fixedly connected to the rotatable drum dial member.

Figure 7:
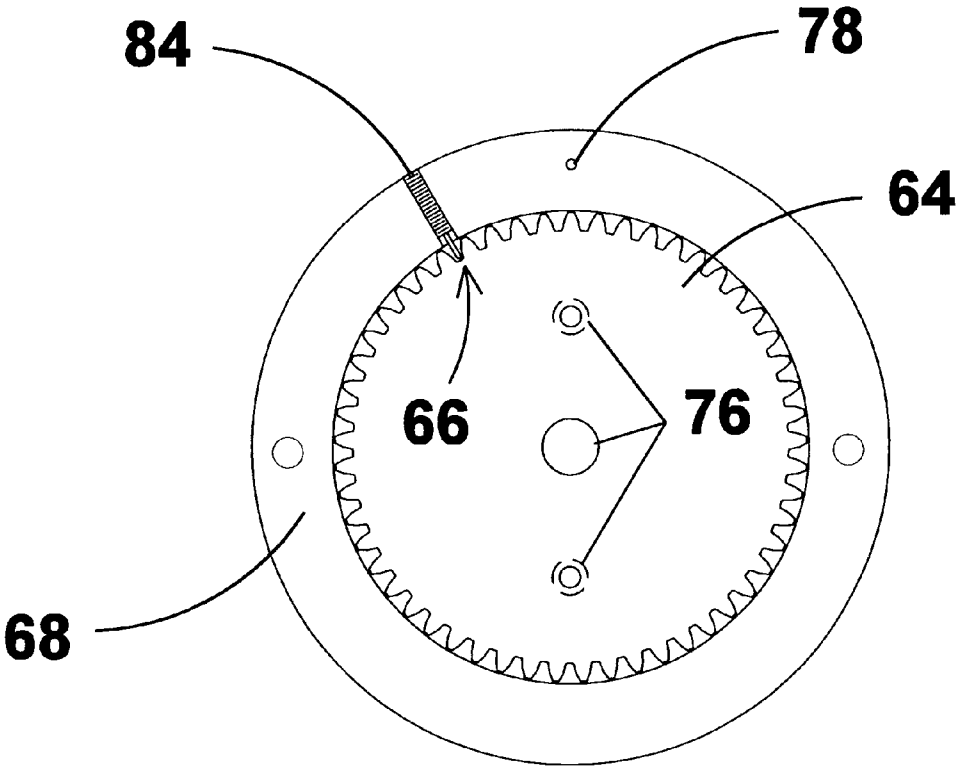

FIG. 7 is a front view of a spool retaining member having a stud like projection which communicates with the arc cavity of the rotational limiting element to limit the degrees of rotation of the rotatable drum dial member. Also shown is a spur gear which is fixedly connected to the rotatable drum dial member which communicates with a pawl-like member extending from the spool-retaining member to maintain the positioning of the rotatable drum dial member and its elements.

Figure 8:
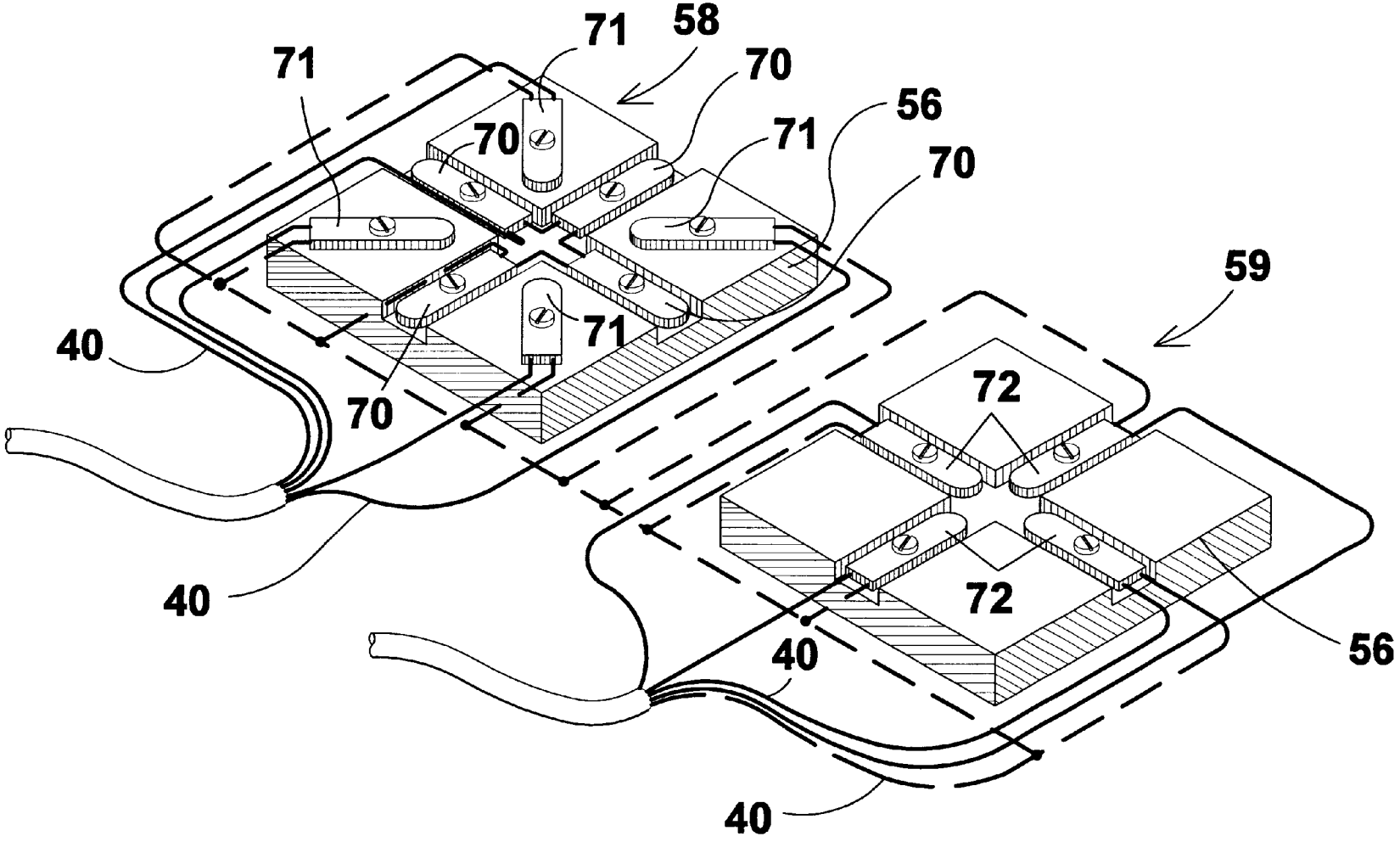

FIG. 8 is a perspective view of the mercury switch holders which are contained with the canister-like housing of the present invention. The first switch holder is comprised of two sets of four switches. The first set is connected in series radiating on an equal slope from the holder center equidistant from each other. The first switch set is connected to a single LED. The second set are individually connected to a mating LED and radiate on an equal slope from the holder center equidistant from each other and interdisposed between the switches of the first set.

The second switch holder is comprised of four switches that are individually connected to a mating LED and radiate on an equal slope from the holder center equidistant from each other. Two switches being parallel to the club shaft and two switches being perpendicular to the club shaft.

Figure 9:
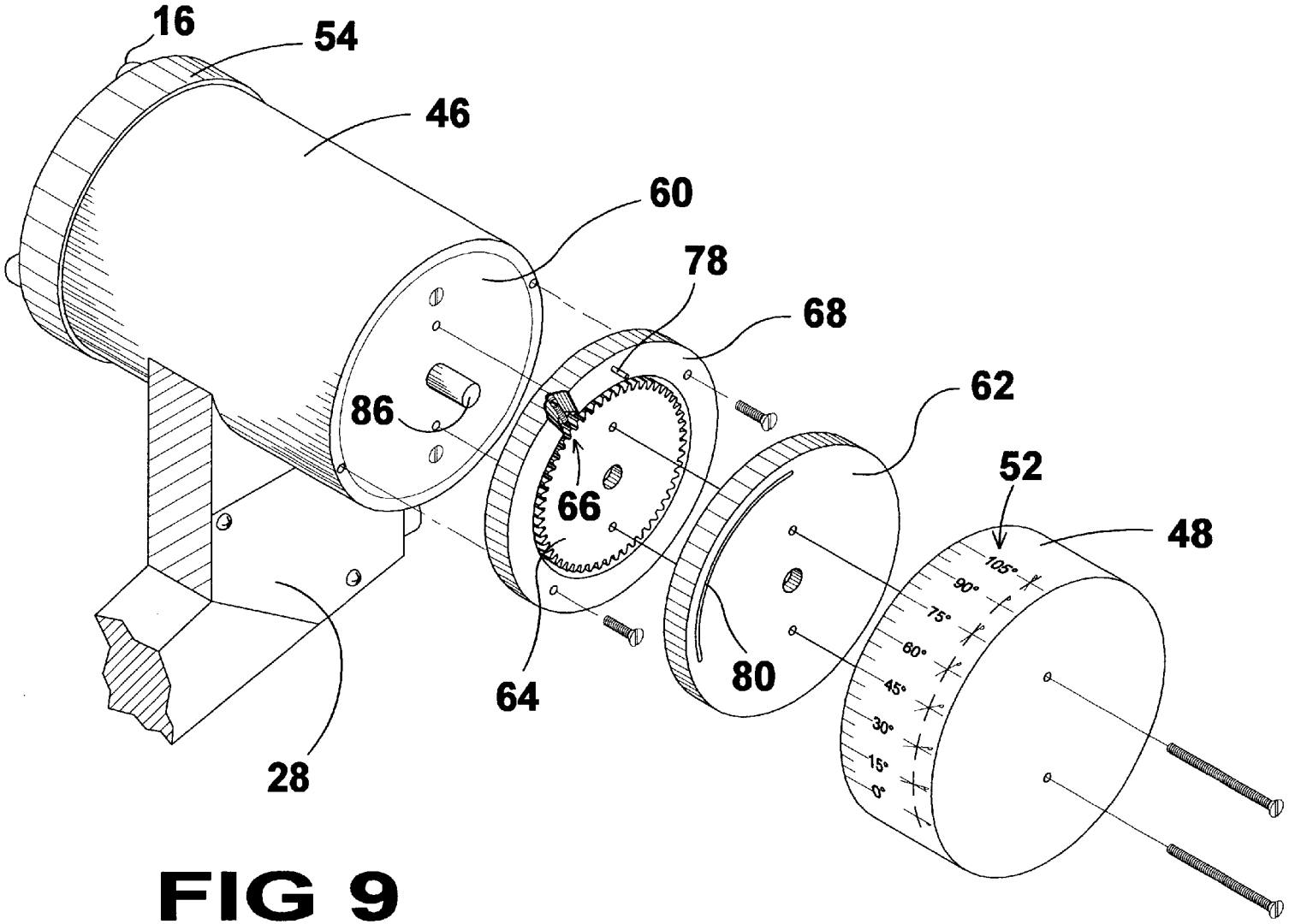

FIG. 9 is a partial exploded view of the rotational drum dial member. Shown fixedly connected to the rotatable drum dial member is a rotational limiting element having an arched cavity providing limited movement for the stub of the spool-retaining member. Also shown is a spur gear element which communicates with a pawl-like member extending from the spool-retaining member to maintain the positioning of the rotatable drum dial member and its elements.

Figure 10:
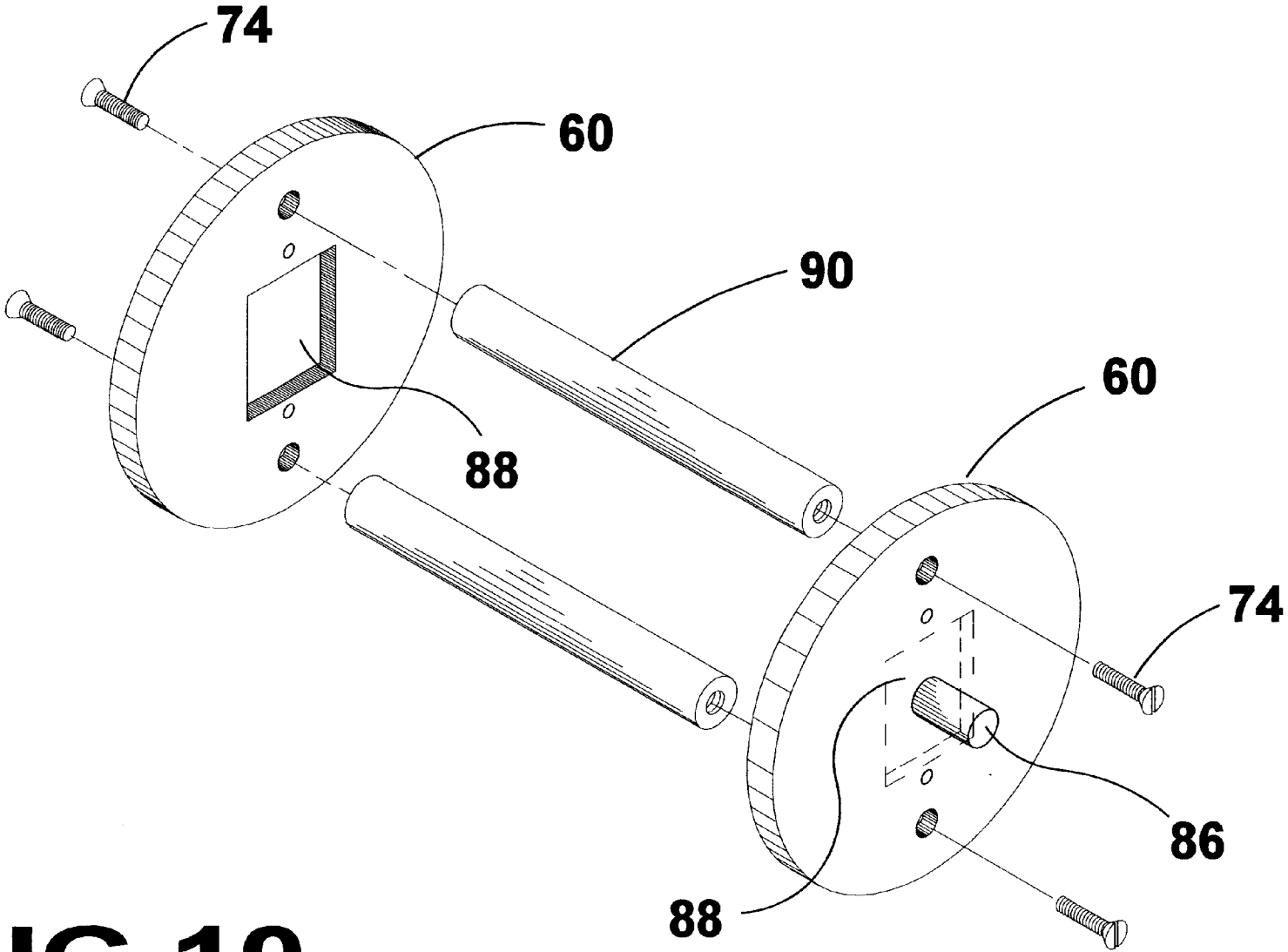

FIG. 10 is an exploded view of the two discs forming a spool-like support element for the first mercury switch holder and the second mercury switch holder.

Figure 11:
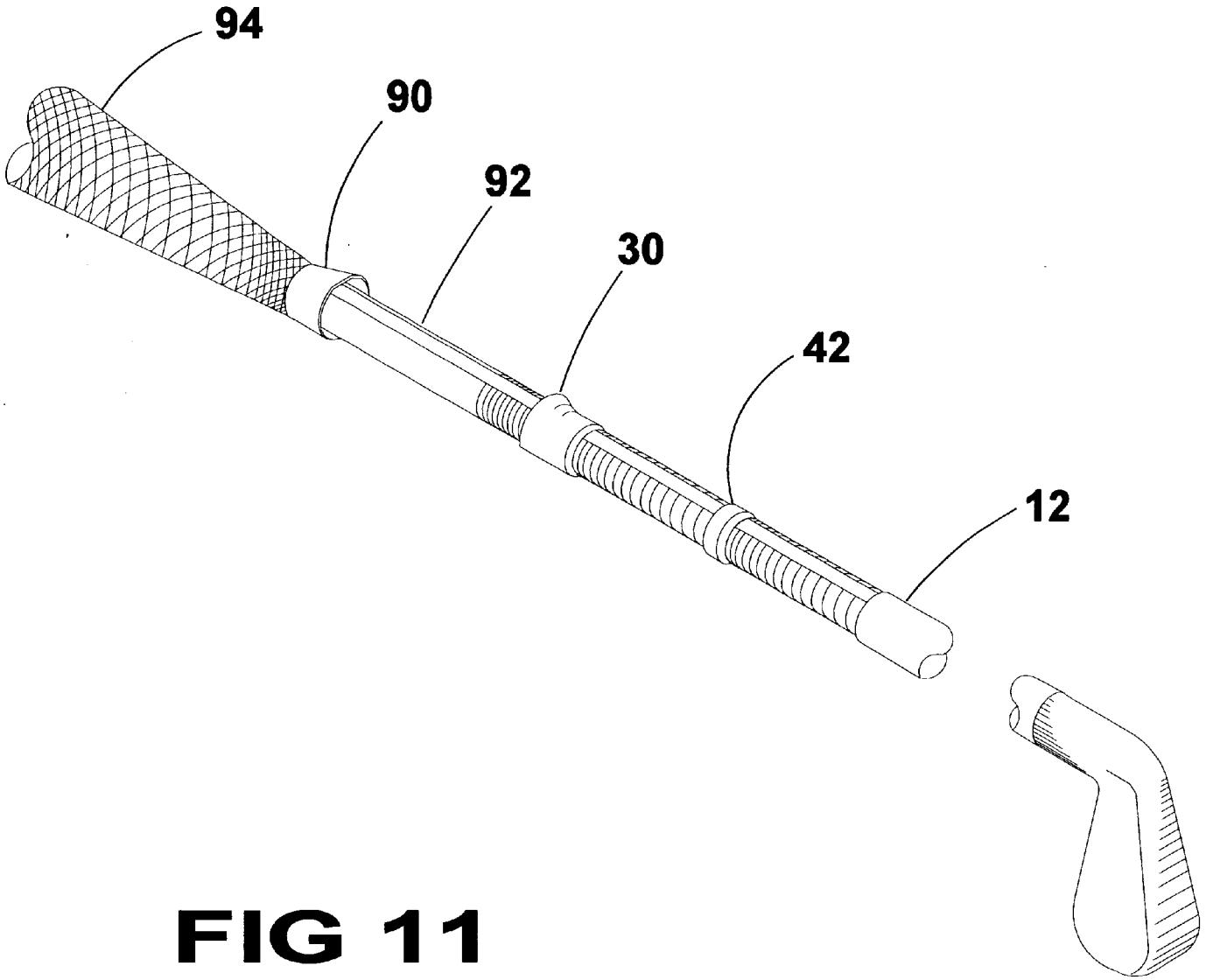

FIG. 11 is a perspective view of the golf club of the present invention. Shown are slidable movable clamps for attaching the visual indicator to the golf club shaft.

Figure 12:
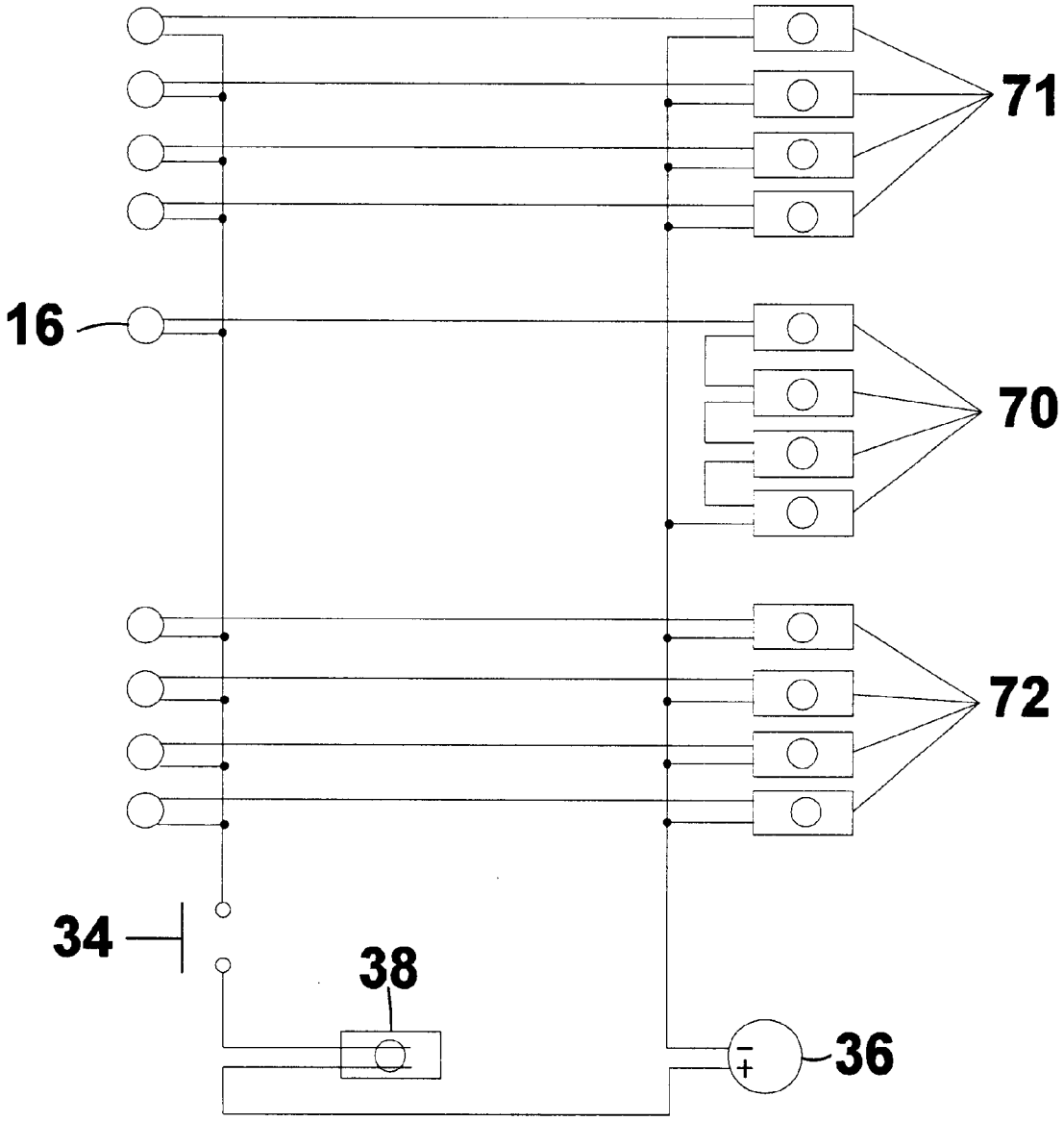

FIG. 12 is an illustrative wiring diagram showing the mercury switches and related LED's. Shown are switches individually connected to a mating LED. Also shown are four switches connected in series to a single LED. Another four switches are individually connected to a mating LED.

LIST OF REFERENCE NUMERALS

With regard to reference numerals used, the following numbering is used throughout the drawings.

10 present invention
12 golf club shaft
14 indicating light device
16 LED
18 golfer
20 club head
22 shoulder
24 top of back swing
26 direction arrows
28 means for attaching
30 clamp
32 base
34 on/off switch
36 power source
38 mercury switch
40 electrical wire
42 collar
44 threads
46 housing
48 dial member
50 indicator arrow
52 scale of degrees
54 LED end of housing
56 platform
58 first mercury switch holder
59 second mercury switch holder
60 disc
62 rotational limiting element
64 spur gear
66 pawl
68 retaining element
70 first set four switches
71 second set four switches
72 set of four switches
74 fasteners
76 apertures
78 stud
80 cavity
84 spring plunger
86 shaft
88 switch apertures
90 fixed clamp
92 base seat
94 grip

DESCRIPTION OF THE PREFERRED EMBODIMENT(S)

In order that the invention may be more fully understood, it will now be described by way of example, with reference to the accompanying drawings in which FIGS. 1 through 12 illustrate the present invention being a device for improving a golf swing.

Figure 1:
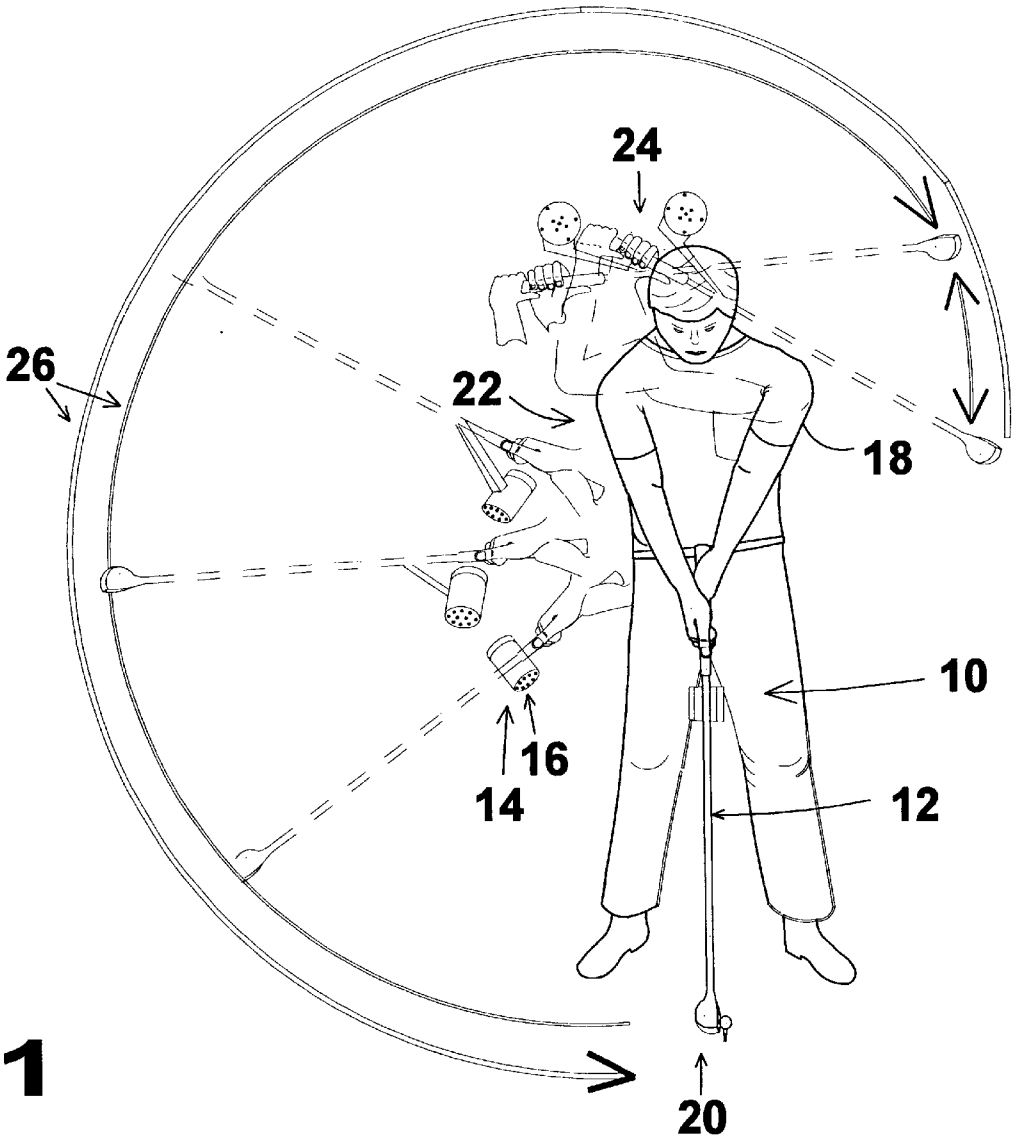
FIG. 1 is an illustrative view of the present invention in use. Shown is a golf club having the swing indicator device attached thereto. The visual indicator device having a plurality of LED's can indicate to the golfer if the desired position of the golf club shaft and rotation of the golf club head has been achieved by looking over the shoulder while the club is at the top of the backswing.

Turning to FIG. 1, shown therein is an illustrative view of the present invention 10 in use. Shown is a golf club 12 having the swing indicator device 14 attached thereto. The visual indicator device 14 having a plurality of LED's 16 can indicate to the golfer 18 if the desired position of the golf club shaft 12 and rotation of the golf club head 20 has been achieved by looking over the shoulder 22 while the club is at or near the top 24 of the backswing as shown by direction arrows 26.

Figure 2:
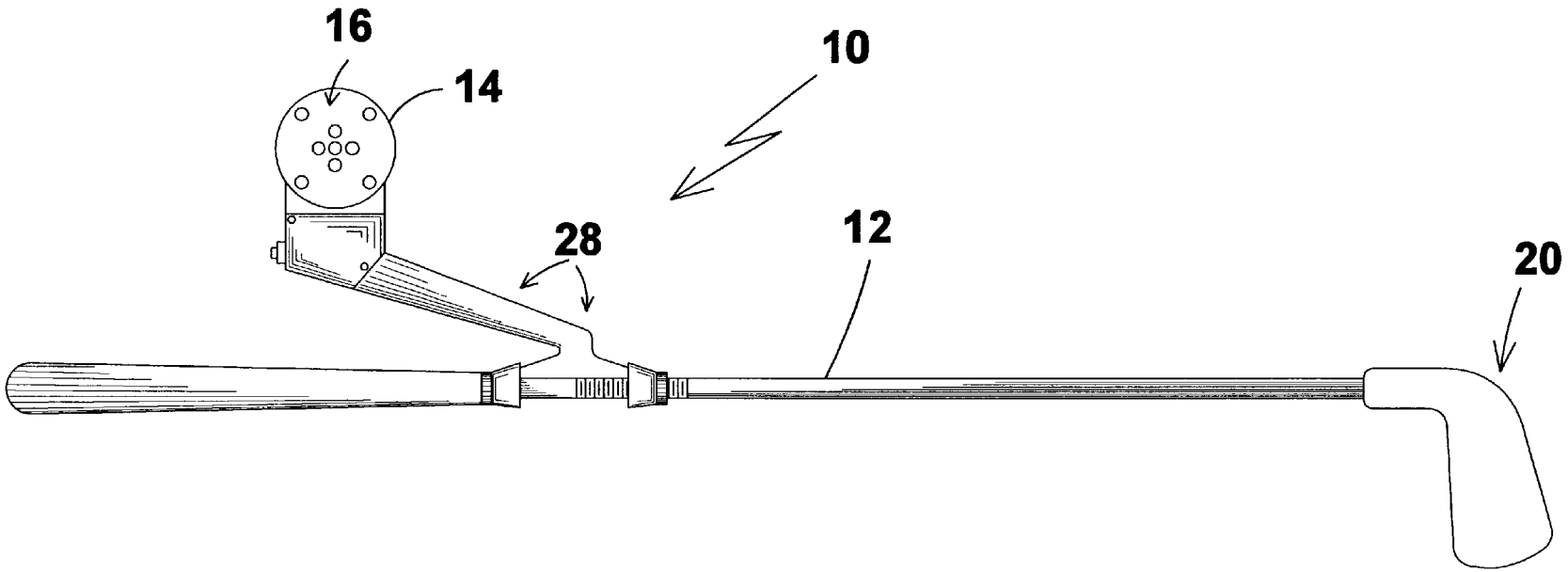
FIG. 2 is a perspective view of the present invention attached to a golf club. Shown is a visual indicator device having means for attaching said device to a golf club. Also shown are a plurality of LED's which are triggered by a plurality of internal mercury switches to provide the golfer with a real time reference as to the relative position of the golf club shaft and golf club head which can be view by the golfer while the club is at the top of the backswing.

Turning to FIG. 2, shown therein is a perspective view of the present invention 10 attached to a golf club 12. Shown is a visual indicator device 14 having means 28 for attaching the device to a golf club. Also shown are a plurality of LED's 16 which are triggered by a plurality of internal mercury switches (not shown) to provide the golfer with a real time reference as to the relative position of the golf club shaft 12 and golf club head 20 which can be viewed by the golfer while the club is at the top of the backswing.

Figure 3:
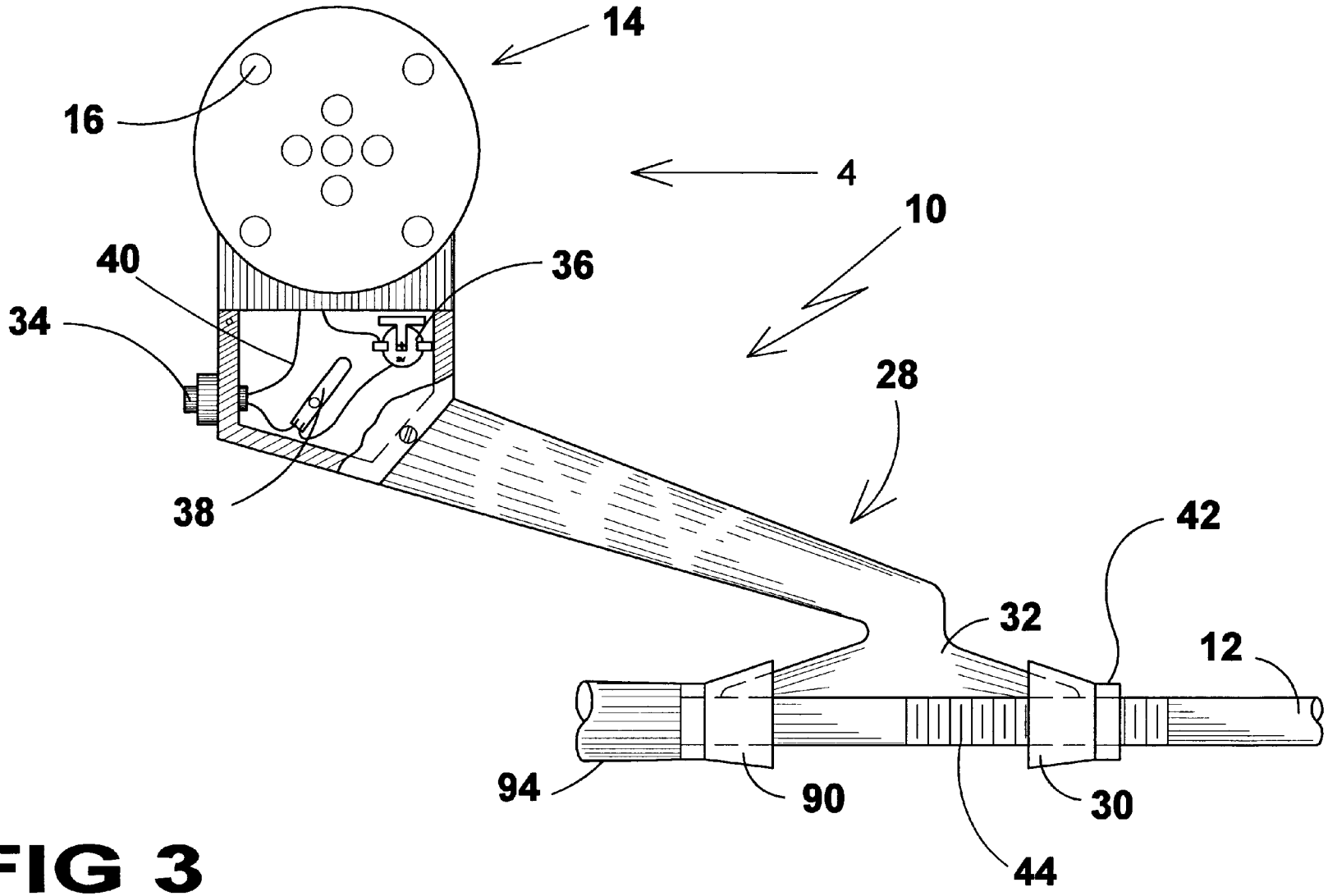
FIG. 3 is an exploded partial cutaway view of the present invention mounted onto a golf club. Shown are slidably movable mounting members which clamp onto the base of the visual indicator. Also shown is a power switch connected to a power source having a mercury switch which will conserve power by only completing the circuit when the golf club is at or near the top of the backswing. Also shown are a plurality of LED's which will provide the golfer with an accurate visual indicator as to the position of the golf club shaft relative to being parallel to the ground. An the golf club head relative to the desired angle of rotation of the club head as previously set by the golfer using the rotational drum dial member.

Turning to FIG. 3, shown therein is an exploded partial cutaway view of the present invention 10 mounted onto a golf club 12. Shown is a slidably movable mounting clamp member 30 which clamp uses a threaded 44 locking collar 42 for securement onto the base 32 of the visual indicator 14 and fixed clamp 90. Also shown is a power on/off switch 34 connected by appropriate electrical circuit connections 40, e.g., wire, to a power source 36 having an on/off mercury switch 38 which will conserve power by only completing the circuit 40 when the golf club 12 is at or near the top of the backswing. Also shown are a plurality of LED's 16 which will provide the golfer with an accurate visual indicator as to the position of the golf club shaft 12 relative to being parallel to the ground and the golf club head relative to the desired angle of rotation of the club head as previously set by the golfer using the rotational drum dial member.

Figure 4:
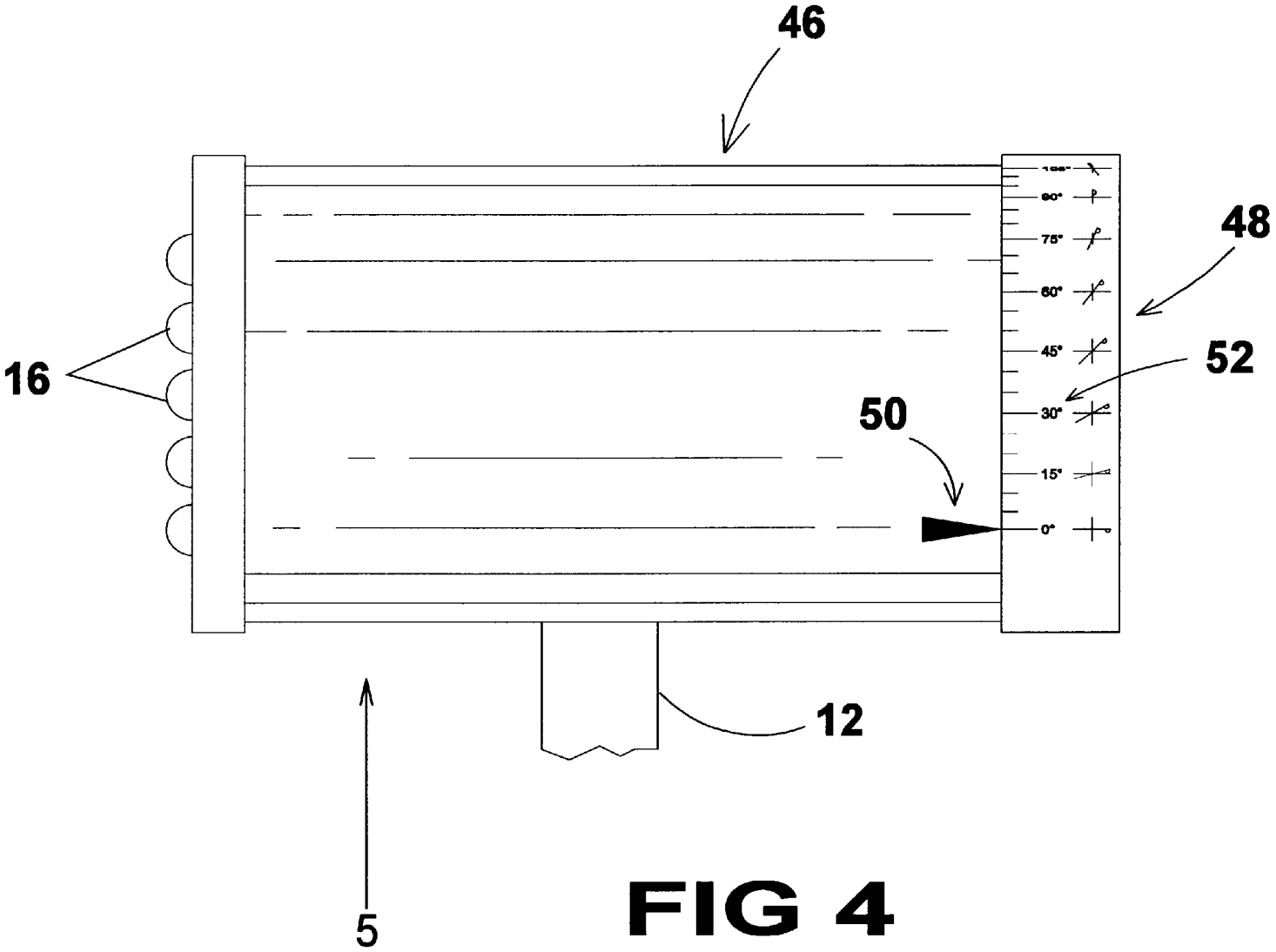
FIG. 4 is an enlarged view of the canister-like housing of the present invention. Shown is a rotatable drum dial member whereby the golfer can selected the desired rotation of the club head. Also shown are a plurality of LED's which will light based on the position of the golf club shaft at the top of the backswing and the rotation of the golf club head at the top of the backswing which will be displayed by the mercury switched completing circuits which will cause certain LED's to light.

Turning to FIG. 4, shown therein is an enlarged view of the canister-like housing 46 of the present invention. Shown is a rotatable drum dial member 48 whereby the golfer can select from the scale of degrees 52 the desired rotation of the club head using indicator arrow 50. Also shown are a plurality of LED's 16 which will light based on the position of the golf club shaft 12 at the top of the backswing and the rotation of the golf club head at the top of the backswing which will be displayed by the mercury switches which completes the circuit which will cause certain LED's 16 to light.

Figure 5:
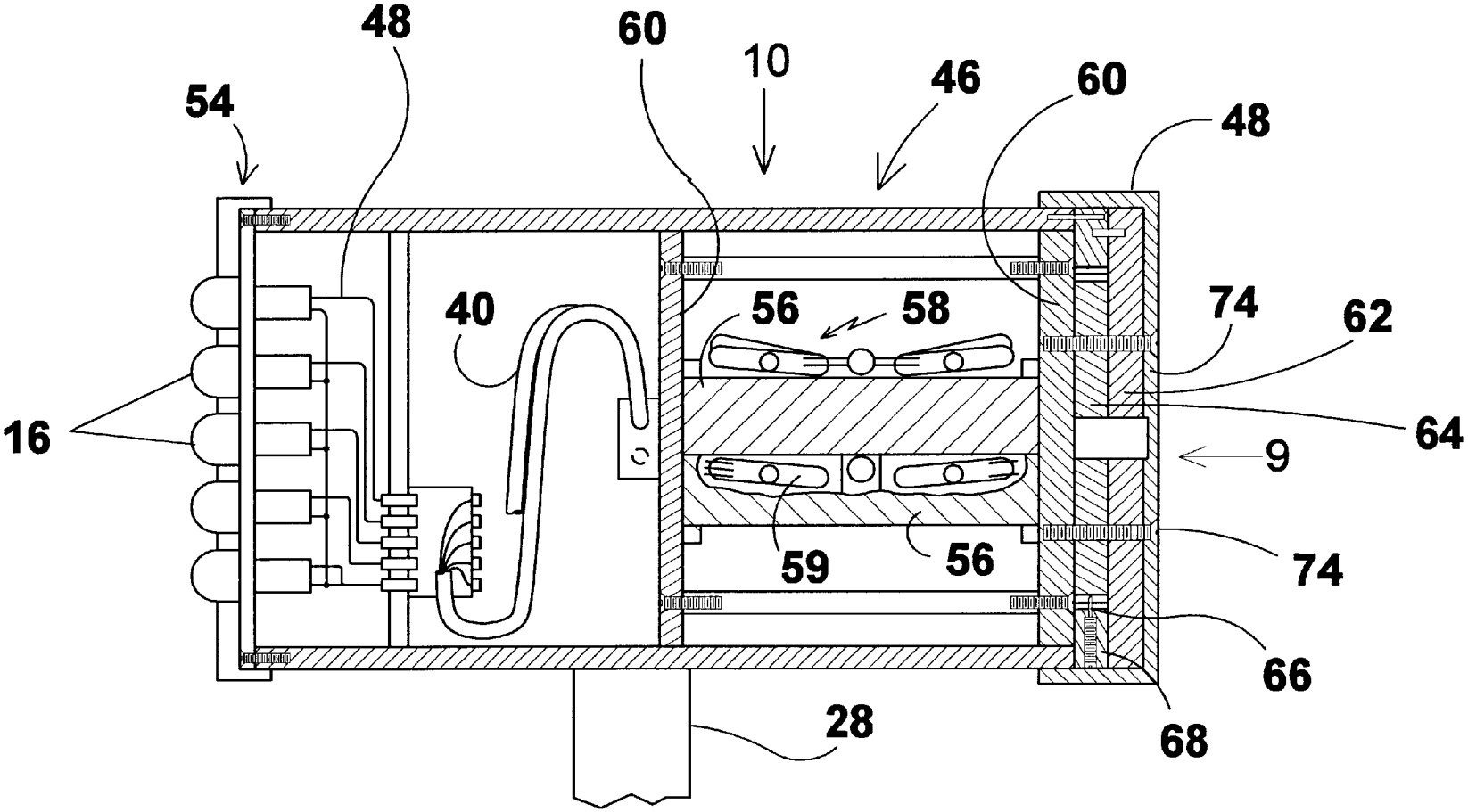
FIG. 5 is a cutaway view of the canister-like housing of the present invention. Shown is the canister-like housing has a rotatable drum dial member having a scale of degrees of arc marked on the exterior periphery, as shown in FIG. 4, to permit the user to pre-select the desired rotation of angle of the golf club shaft in relationship to the ground. The canister-like housing member has an array of LED's on the external surface at one end of the canister-like housing end and the rotatable drum dial member on the distal housing end. The rotatable drum dial member is comprised of a number of fixedly connected elements which function in concert having the LED's providing the visual indication of the position of the golf club.

Turning to FIG. 5, shown therein is a cutaway view of the canister-like housing 46 of the present invention. Shown is the canister-like housing 46 and attachment means 28 having a rotatable drum dial member 48 having a scale of degrees of arc marked on the exterior periphery, as shown in FIG. 4, to permit the user to pre-select the desired rotation of angle of the golf club shaft in relationship to the ground. The canister-like housing member 46 has an array of LED's 16 on the external surface at one end of the canister-like housing end 54 and the rotatable drum dial member 48 on the distal housing end. The rotatable drum dial member 48 is comprised of a number of fixedly connected elements 56, 60, 62, 64, 66, 68 which function in concert allowing the LED's 16 to provide the visual indication of the position of the golf club.

The rotatable drum dial member 48 is fixedly connected to two platforms 56 having mounted thereon a first 58 and a second 59 mercury switch holder (also see switches 70, 71, 72 on FIG. 8) retained between two discs 60 forming a spool-like support element for the first mercury switch holder 58 and the second mercury switch holder 59. Also, fixedly connected with fasteners 74 to the rotatable drum dial member 48 is a rotational limiting element 62 and a spur gear element 64 which communicates with a pawl-like member 66 extending from the spool retaining member 68 to maintain the positioning of the rotatable drum dial member 48 and its elements. Electrical wiring 40 is also shown.

Turning to FIG. 6, shown therein is a front view of the rotational limiting element 62 which is fixedly connected with fastener means 74 (See FIG. 5) through aperture 76 to the rotatable drum dial member 48. Cavity 80 is also shown along with a central aperture 76 for receiving the center shaft.

Turning to FIG. 7, shown therein is a front view of a spool retaining member 68 having a stud like projection 78 which communicates with the arc cavity 80 of the rotational limiting element 62 to limit the degrees of rotation of the rotatable drum dial member 48. Also shown is a spur gear 64 which is fixedly connected through apertures 76 to the rotatable drum dial member which gear communicates with a pawl-like member 66 extending inwardly from the spool retaining member 68 to maintain the positioning of the rotatable drum dial member and its elements along with the spring plunger holder or spool retaining member 68 and the spring plunger 84.

Turning to FIG. 8, shown therein is a perspective view of the platforms 56 of mercury switch holders 58, 59 which are contained within the canister-like housing of the present invention. The first switch holder 58 is comprised of two sets 70, 71 of four switches. The first set 70 is connected in series radiating on an equal slope from the holder center equidistant from each other. The first switch set is connected to a single LED. The second set 71 are individually connected to a mating LED and radiate on an equal slope from the holder center equidistant from each other and interdisposed between the switches 70 of the first set.

The second switch holder 59 is comprised of four switches 72 that are individually connected to a mating LED's and radiate on an equal slope from the holder center equidistant from each other. Two switches being parallel to the club shaft and two switches being perpendicular to the club shaft. Electrical connectors 40 are shown in all cases. Switches 70, 71 and 72 are designed to provide a means for sensing the physical relationship between the golf club 12 and the ground, to thereby actuate the LED indicators so that the user can improve his swing.

Turning to FIG. 9, shown therein is a partial exploded view of the rotational drum dial member 48. Shown fixedly connected to the rotatable drum dial member 48 is a rotational limiting element 62 having an arched cavity 80 providing limited movement for the stud 78 of the spool retaining member 68. Also shown is a spur gear element 64 which communicates with a pawl-like member 66 extending from the spool retaining member 68 to maintain the positioning of the rotatable drum dial member 48 and its elements along with fasteners 74 and shaft 86. Other elements previously disclosed are also shown.

Turning to FIG. 10, shown therein is an exploded view of the two discs 60 forming a spool-like support element for the first mercury switch holder 58 (not shown) and the second mercury switch holder 59 (not shown) which are held in square-shaped apertures 88. Also shown are threaded standoffs 90, fasteners 74 and shaft 86.

Turning to FIG. 11, shown therein is a perspective view of the golf club 12 of the present invention. Shown is a slidable movable clamp 30 for attaching the visual indicator to the golf club shaft 12. Collar 42, the fixed clamp 90, a base seat 92, and grip 94 are also shown.

Turning to FIG. 12, shown therein is an illustrative wiring diagram showing the mercury switches 38, 70, 71, 72 and related LED's 16. Shown are switches 72 individually connected to a mating LED. Also shown are four switches 70 connected in series to a single LED. Another four switches 71 are individually connected to a mating LED. Other elements previously disclosed are also shown.

What is claimed to be new and desired to be protected by letters patent is set forth in the appended claims:

1. An apparatus for a golf swing training device, comprising:

a) a golf club having a shaft;

b) a housing for containing parts of the apparatus, said housing having a first and a second end;

c) means for removably fixedly attaching said housing to said golf club, said housing being stationary with respect to said shaft once said training device is installed for use;

d) means comprising a visual indicator mounted on said first end of said housing;

e) a rotational dial member having a visual graduated scale in degrees mounted on said second end of said housing;

f) means for sensing the angular relationship of said golf club with the ground, said means for sensing mounted internal said housing;

g) means for connecting said means for sensing to said rotational dial member whereby the means for sensing is adjustable, an outside wall of said housing having a pointer aligned with said scale so that rotation of said dial member permits said indicator to select an angle on said dial member representing the angular relationship of said golf club with the ground;

h) a source of power for said visual indicator, said source of power having a control switch;

i) means for electrically connecting said visual indicator, said source of power, and said means for sensing, whereby the angular adjustment of said dial member selects the intended angular relationship of said golf club to the ground and the user can relate his swing to the ground as shown by the visual indicator; and j) said means for connecting said means for sensing to said rotational dial member further comprising a pair of discs mounted internal of said housing, said pair of discs being spaced apart and joined together by multiple stand-off members, said pair of discs and said multiple stand-offs forming a means for supporting said means for sensing whereby said means for sensing ate secured to said means for supporting said means for sensing.

2. The apparatus of claim 1, wherein said housing has the shape of a cylinder.

3. The apparatus of claim 1, said means for removably fixedly attaching said housing to said golf club further comprises said housing having a base thereon.

4. The apparatus of claim 3, said means for fixedly attaching further comprising a base seat on said golf club shaft, said base seat having a movable clamp on a first end, said base seat having a fixed clamp on a second end, said movable and said fixed clamps for receiving said base of said housing.

5. The apparatus of claim 4, said base seat further comprises threads, said base seat further comprising a threaded locking collar for mating to said threads on said base seat whereby said movable clamp is secured to said base of said housing.

6. The apparatus of claim 1, said means for a visual indicator further comprising multiple light emitting diodes.

7. The apparatus of claim 1, said means for sensing further comprising multiple mercury switches.

8. The apparatus of claim 7, said switches further comprising a first set of switches connected in series, said first set of switches connected to a single light emitting diode.

9. The apparatus of claim 8, said switches further comprising a second set of switches individually connected to a mating light emitting diode.

10. The apparatus of claim 9, wherein a portion of said second set of switches are disposed parallel to said golf club shaft.

11. The apparatus of claim 9, wherein a portion of said second set of switches are disposed perpendicular to said golf club shaft.

12. The apparatus of claim 1 having a rotational limiting element, said rotational limiting element being fixedly attached internal to said rotational dial member, said rotational limiting being fixedly attached to one of said pair of discs mounted internal of said housing whereby rotation of said means for sensing is adjustable.

13. The apparatus of claim 12 having a spur gear with teeth mounted internal of a retaining element, said retaining element mounted between said rotational limiting element and one of said pair of discs, said retaining element having an adjustable pawl extending inwardly toward its central axis, said teeth of said spur gear communicating with said pawl, said spur gear being thereby rotationally fixably movably positioned by said pawl.

* * * * *